US007033165B1

(12) United States Patent
Brown

(10) Patent No.: US 7,033,165 B1
(45) Date of Patent: Apr. 25, 2006

(54) GAS FURNACE CONTROLLER

(76) Inventor: Delton R. Brown, 4046 Indian Sunrise, San Antonio, TX (US) 78244

( * ) Notice: Subject to any disclaimer, the term of this patent is extended or adjusted under 35 U.S.C. 154(b) by 0 days.

(21) Appl. No.: 10/278,574

(22) Filed: Oct. 23, 2002

Related U.S. Application Data

(60) Provisional application No. 60/358,513, filed on Feb. 21, 2002.

(51) Int. Cl.
*F23N 5/24* (2006.01)

(52) U.S. Cl. ..... 431/22; 431/18; 431/2

(58) Field of Classification Search ..... 431/226, 431/18, 2; 126/116 A; 110/185
See application file for complete search history.

(56) References Cited

U.S. PATENT DOCUMENTS 4,561,288 A * 12/1985 Moenkhaus ..... 73/23.32
5,239,980 A * 8/1993 Hilt et al. ..... 126/116 A
5,576,739 A * 11/1996 Murphy ..... 340/3.4
5,807,098 A * 9/1998 Deng ..... 432/36
5,838,243 A * 11/1998 Gallo ..... 340/632
5,896,089 A * 4/1999 Bowles ..... 340/632
6,318,150 B1 * 11/2001 Temple ..... 73/23.31
6,339,379 B1 * 1/2002 Argus et al. ..... 340/632
6,484,951 B1 * 11/2002 Mueller ..... 237/2 A

* cited by examiner

*Primary Examiner*—Alfred Basichas
(74) *Attorney, Agent, or Firm*—Wayne J. Colton, Inc.

(57) ABSTRACT

A gas furnace controller for disrupting the flow of gas to a gas furnace upon detection of excessive levels of carbon monoxide comprises an air sample collector in fluid communication with a carbon monoxide detector, a gas supply shutoff circuit for controlling a valve in a gas supply line to the gas furnace; and a controller in electrical communication with the carbon monoxide detector and the gas supply shutoff circuit. The controller is adapted to actuate the gas supply shutoff circuit and sound an audible alarm in response to detection by the carbon monoxide detector of a predetermined level of carbon monoxide.

18 Claims, 3 Drawing Sheets

GAS FURNACE CONTROLLER

RELATED APPLICATION

This application claims, under 35 U.S.C. § 119(e) all available benefit of U.S. provisional patent application Ser. No. 60,358,513 filed Feb. 21, 2002. By this reference, the full disclosure of U.S. provisional patent application Ser. No. 60,358,513 is incorporated herein as though now set forth in its entirety.

FIELD OF THE INVENTION

The present invention relates to gas furnaces. More particularly, the invention relates to a controller for a gas furnace that automatically shuts off the supply of gas to the furnace and sounds an alarm upon the detection of an excessive level of carbon monoxide the furnace's plenum to a home's heating duct.

BACKGROUND OF THE INVENTION

Hundreds of deaths per year are attributed to accidental carbon monoxide poisoning within residential dwellings. May of these deaths occur due to a malfunction within a gas furnace. Although technologically feasible, little effort has been made toward increasing the safety of gas furnaces.

Recognizing the tragic consequences that all too often result from a gas furnace malfunction, it is an overriding object of the present invention to improve over the prior art by providing an additional measure of safety in the operation of a gas furnace. In particular, it is an object of the present invention to provide a system and method whereby the level of carbon monoxide in the air flowing from a gas furnace into the residential portions of a building is monitored and, if excessive, gas flow to the furnace is immediately interrupted. Finally, it is an object of the present invention to provide such a system that is reliable in operation and economical in implementation, thereby making the system readily available as a standard component for any gas furnace.

SUMMARY OF THE INVENTION

In accordance with the foregoing objects, the present invention—a gas furnace controller for disrupting the flow of gas to a gas furnace upon detection of excessive levels of carbon monoxide—generally comprises an air sample collector in fluid communication with a carbon monoxide detector, a gas supply shutoff circuit for controlling a valve in a gas supply line to the gas furnace; and a controller in electrical communication with the carbon monoxide detector and the gas supply shutoff circuit. The controller, which may comprise a micro-controller, is adapted to actuate the gas supply shutoff circuit in response to detection by the carbon monoxide detector of a predetermined level of carbon monoxide. In the preferred embodiment of the present invention, the controller also sounds an audible alarm, such as a piezoelectric buzzer, upon detection of an excessive level of carbon monoxide.

Finally, many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein:

FIG. 2 shows, in a schematic block diagram, details of the carbon monoxide analyzer of the gas furnace controller of FIG. 1.

DETAILED DESCRIPTION OF THE PREFERRED EMBODIMENT

Although those of ordinary skill in the art will readily recognize many alternative embodiments, especially in light of the illustrations provided herein, this detailed description is exemplary of the preferred embodiment of the present invention, the scope of which is limited only by the claims appended hereto.

Figure 1:
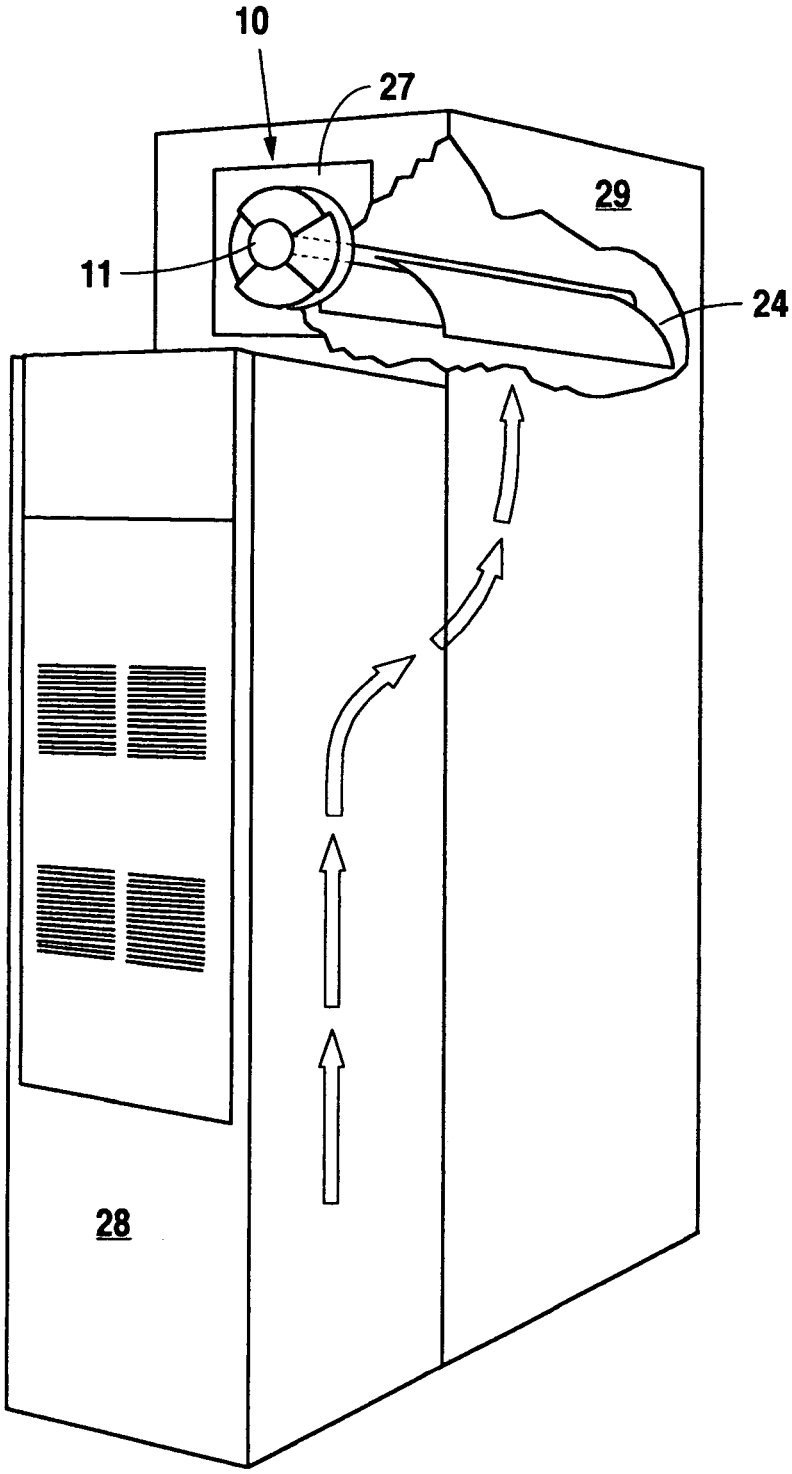
FIG. 1 shows, in a partially cutaway perspective view, the preferred embodiment of the gas furnace controller of the present invention as installed for use in a gas furnace.

Referring now to the figures, the gas furnace controller 10 of the present invention is shown to generally comprise a carbon monoxide analyzer 11 in fluid communication with an air sample collection tube 24, which is preferably located within the plenum 29 leading from a gas furnace 28 to a heating duct. As particularly shown in FIGS. 1 and 2, the carbon monoxide analyzer 11 and the air sample collection tube 24 may be dependently supported on opposite sides of a mounting plate 27 affixed to the wall of the plenum 29. In this manner, the gas furnace controller 10 of the present invention may be readily installed either upon initial installation of the gas furnace 28 or as an after market product.

Figure 2:
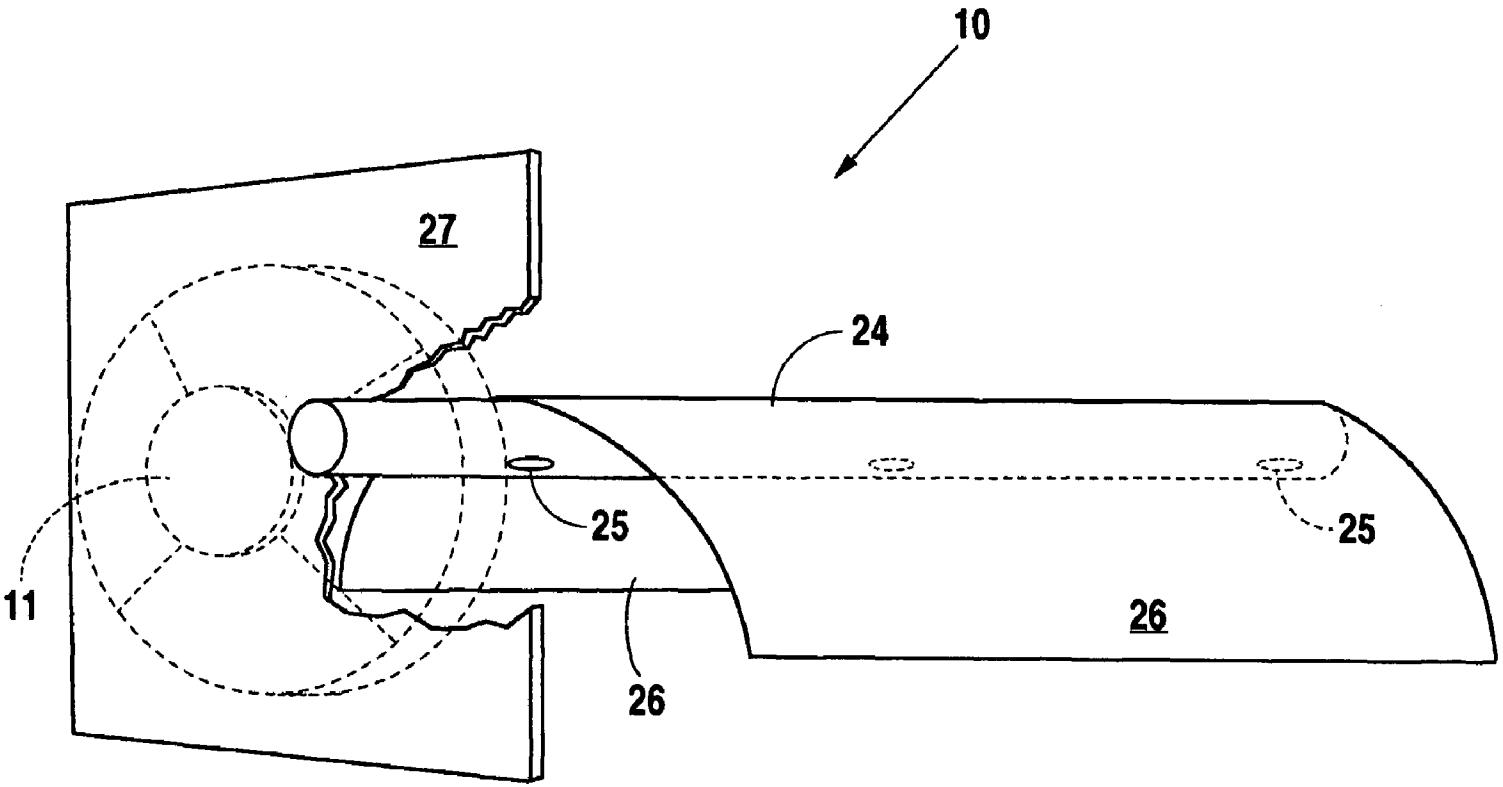
FIG. 2 shows, in a partially cutaway perspective view, details of the gas furnace controller of FIG. 1.

As shown in FIG. 2, the air sample collection tube 24 generally comprises a cylindrical tube closed at one end and open at the other end leading to the carbon monoxide analyzer 11. The collection tube 24 also comprises one or more inlets 25 through which sampled air from within the plenum 29 is directed to a carbon monoxide detector 13 in the carbon monoxide analyzer 11, as will be better understood further herein. A plurality of wings 26 may also be provided on the air sample collection tube 24 to facilitate airflow into the air sample collection tube 24.

Figure 3:
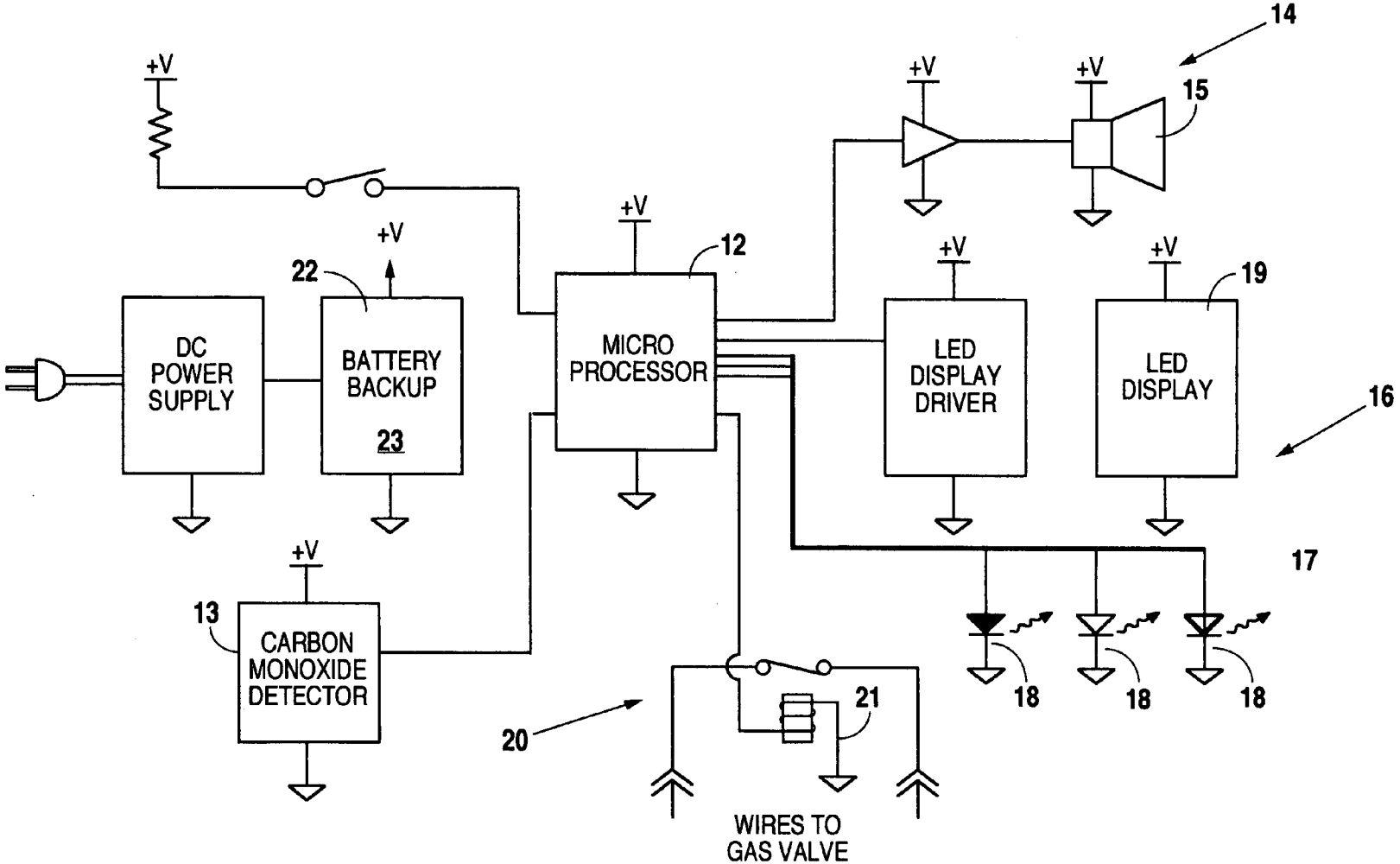

As shown in FIG. 3, the carbon monoxide analyzer 11 generally comprises a carbon monoxide detector 13, for determining the presence of carbon monoxide in the air sampled through the air sample collection tube 24, and a gas supply shutoff circuit 20, for interrupting gas supply to the gas furnace 28 should an excessive level of carbon monoxide be detected in the airflow through the plenum 29. Although those of ordinary skill in the art will recognize many substantially equivalent embodiments, the present invention comprises a micro-controller 12 programmed to monitor the signals generated by the carbon monoxide detector 13, and in response to the monitored signals, to effect appropriate control over the gas supply shutoff circuit 20. In particular the micro-controller 12 operates to control one or more relays 21, which in turn operate one ore more solenoid valves in the gas supply line to the gas furnace 28.

The carbon monoxide analyzer 11 also preferably comprises an audio alarm 14, such as a piezoelectric buzzer 15, and/or a visual alarm 16. In particular, the preferred embodiment of the present invention comprises one or more status indicators 17, such as light emitting diodes 18, and a text display 19, which may comprise a liquid crystal display or any other substantially equivalent device. The light emitting diodes 18 are preferably color-coded to indicate the operating status of the gas furnace controller 10. In particular one light emitting diode 18 is green to indicate that the gas furnace controller 10 is operable and that no excessive levels of carbon monoxide are present in the plenum 29. A yellow light emitting diode 18 may be utilized to indicate a non-emergent malfunction. For example, in an embodiment comprising a backup power supply 22 having a battery 23, a yellow light emitting diode 18 may be utilized to indicate that the battery 23 requires replacement. Finally, a red light emitting diode 18 may be utilized to indicate that the gas furnace controller 10 has determined the existence of an excessive level of carbon monoxide within the plenum 29. In the preferred embodiment of the present invention, such an indication would also be accompanied by activation of the piezoelectric buzzer 15.

In the event that the gas furnace controller 10 determines the existence of an excessive level of carbon monoxide within the plenum 29, the micro-controller operates the gas supply shutoff circuit 20 to immediately interrupt the supply of gas to the gas furnace 28. Additionally, the audio alarm 14 is sounded and the status indicator 17 is set to alert residents to the alarm condition. The text display 19, which ordinarily may display the real time level of carbon monoxide within the plenum 29, is utilized following the alarm condition to display the highest level of carbon monoxide detected within the plenum 29. In the preferred embodiment of the present invention, the micro-controller 12 is programmed to maintain all alarm conditions until a service technician activates a reset switch 30. For increased safety, the reset switch 30 may be located within the housing of the carbon monoxide analyzer 11 or on the inside of the mounting plate 27 within the plenum 29. In this manner, a homeowner may be prevented from simply resetting the gas furnace controller 10 without consulting a service technician.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and claims drawn thereto. In any case, because the scope of the present invention is much broader than any particular embodiment, the foregoing detailed description should not be construed as a limitation of the scope of the present invention, which is limited only by the claims appended hereto.

What is claimed is:

1. A gas furnace controller for disrupting the flow of gas to a gas furnace upon detection of excessive levels of carbon monoxide, said gas furnace controller comprising:

an air sample collector in fluid communication with a carbon monoxide detector, said air sample collector comprising a tubular chamber;

a gas supply shutoff circuit for controlling a valve in a gas supply line to the gas furnace;

a controller in electrical communication with said carbon monoxide detector and said gas supply shutoff circuit, said controller being adapted to actuate said gas supply shutoff circuit in response to detection by said carbon monoxide detector of a predetermined level of carbon monoxide;

wherein:

said tubular chamber comprises an air sample inlet; and said air sample collector further comprises an airfoil for directing airflow through said air sample inlet.

2. The gas furnace controller as recited in claim 1, wherein said tubular chamber comprises a plurality of air sample inlets.

3. The gas furnace controller as recited in claim 1, wherein said controller comprises a micro-controller.

4. The gas furnace controller as recited in claim 3, said gas furnace controller further comprising an audible alarm.

5. The gas furnace controller as recited in claim 4, wherein said audible alarm comprises a piezoelectric buzzer.

6. The gas furnace controller as recited in claim 4, wherein said micro-controller is adapted to sound said audible alarm in response to detection by said carbon monoxide detector of said predetermined level of carbon monoxide.

7. The gas furnace controller as recited in claim 3, said gas furnace controller further comprising a status indicator.

8. The gas furnace controller as recited in claim 7, wherein said status indicator comprises a light emitting diode.

9. The gas furnace controller as recited in claim 8, wherein said status indicator comprises a plurality of light emitting diodes.

10. The gas furnace controller as recited in claim 8, said gas furnace controller further comprising a display.

11. The gas furnace controller as recited in claim 10, wherein said display comprises a liquid crystal display.

12. The gas furnace controller as recited in claim 11, said gas furnace controller further comprising an audible alarm.

13. The gas furnace controller as recited in claim 12, said gas furnace controller further comprising:

a mounting plate;

a housing for containing said carbon monoxide detector; and wherein said air sample collector and said housing are dependently mounted on opposite sides of said mounting plate.

14. The gas furnace controller as recited in claim 13, wherein said mounting plate is adapted to hold said air sample collector in a plenum leading away from the gas furnace.

15. The gas furnace as recited in claim 3, said gas furnace controller further comprising a reset switch.

16. The gas furnace controller as recited in claim 15, wherein said reset switch is concealed from plain view.

17. The gas furnace controller as recited in claim 16, wherein said reset switch is concealed within a housing containing said carbon monoxide detector.

18. A gas furnace controller for disrupting the flow of gas to a gas furnace upon detection of excessive levels of carbon monoxide, said gas furnace controller comprising:

an air sample collector in fluid communication with a carbon monoxide detector:

a gas supply shutoff circuit for controlling a valve in a gas supply line to the gas furnace:

a micro-controller in electrical communication with said carbon monoxide detector and said gas supply shutoff circuit said micro-controller being adapted to actuate said gas supply shutoff circuit in response to detection by said carbon monoxide detector of a predetermined level of carbon monoxide; and a reset switch concealed from plain view within a plenum leading away from the gas furnace.

* * * * *